US005567184A

United States Patent [19]

Sasai et al.

[11] Patent Number: 5,567,184

[45] Date of Patent: Oct. 22, 1996

[54] CONNECTOR WITH INTEGRAL RETAINER, CONNECTOR CONVEYING AND POSITIONING DEVICE, AND METHOD FOR CONVEYING AND POSITIONING A CONNECTOR

[75] Inventors: Osamu Sasai; Masaji Suzuki; Atsushi Sakatani, all of Yokkaichi, Japan

[73] Assignee: Sumitomo Wiring Systems, Ltd., Mie, Japan

[21] Appl. No.: 347,150

[22] Filed: Nov. 22, 1994

[30] Foreign Application Priority Data

Dec. 9, 1993 [JP] Japan ..... 5-341385

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 3,955,275 | 5/1976 | Loomis et al. . | |
| 4,718,159 | 1/1988 | Bronkowski et al. | 29/564.7 |
| 5,120,269 | 6/1992 | Endo et al. | 439/752 |
| 5,292,262 | 3/1994 | Endo et al. | 439/752 |
| 5,316,504 | 5/1994 | Jinno | 439/595 |
| 5,378,176 | 1/1995 | Sasai | 439/752 |
| 5,435,758 | 7/1995 | Sasai et al. | 439/752 |

FOREIGN PATENT DOCUMENTS

| | | |
|---|---|---|
| 1294388 | 11/1989 | Japan . |
| 5-234660 | 9/1993 | Japan . |
| 2242224 | 9/1991 | United Kingdom . |
| 2260866 | 4/1993 | United Kingdom . |

*Primary Examiner*—Gary F. Paumen
*Attorney, Agent, or Firm*—Oliff & Berridge

[57] ABSTRACT

A connector includes a retainer that can be provisionally retained by a connector positioning device. Each retainer is integrally molded on a connector housing through hinge pieces, and can be attached to the connector housing by fitting a guide slot of each of the retaining pieces on a guide projection. Therefore, the retainer can be attached by a pusher that pushes the retainer in a direction perpendicular to the connector housing. At this time, for attaching the retainer to a provisionally-retained position, there is provided a guide for holding the retainer in such a posture that the retainer can be attached in the provisionally-retained position.

11 Claims, 4 Drawing Sheets

CONNECTOR WITH INTEGRAL RETAINER, CONNECTOR CONVEYING AND POSITIONING DEVICE, AND METHOD FOR CONVEYING AND POSITIONING A CONNECTOR

BACKGROUND OF THE INVENTION

This invention relates to a connector having a retainer integrally molded on a connector housing through flexible hinge pieces, and also to a connector positioning device for placing flexible hinge pieces of the retainer in a provisional retaining position relative to the connector housing. In addition, the invention relates to methods for connecting terminals to a connector housing and for conveying and positioning a connector.

One known connector includes a retainer that is integrally molded on a connector housing through strap-like hinge pieces. The connector housing has terminal receiving chambers having a tubular shape for receiving metal terminals, and a primary retaining lance, provided within the terminal receiving chamber, that prevents the inserted metal terminal from being withdrawn. To further prevent withdrawal, a secondary retainer is provided. Retainer insertion holes are formed in side surfaces of the connector housing and are directed to side surfaces of the terminal receiving chambers. The retainer, having lock projections, is attached to the side portion of the connector housing. Each lock projection, inserted into the associated terminal receiving chamber, engages one side of the metal terminal to lock the metal terminal, thereby effecting the secondary retaining of the metal terminal.

However, before the retainer is attached to the connector housing, the strap-like hinge pieces extend from the connector housing in an exposed manner, and may be broken or cut during conveyance upon engagement with other members.

Moreover, the operation for attaching the retainer to the connector housing is carried out after the metal terminals, which are connected to ends of wires, are inserted into the respective terminal receiving chambers to effect primary retaining. Therefore, the connector housing is first held together with the wires, and then the retainer is positioned with respect to the predetermined portion before the retainer is attached. Thus, the attaching operation is cumbersome.

SUMMARY OF THE INVENTION

To overcome these problems, the retainer is first held in a provisionally-retained position where it does not engage the metal terminals, and after the metal terminals are inserted, the retainer is brought into a completely-retained position where the retainer engages the metal terminals.

In this case, it is desired that the connector should be of such a construction that the retainer can be easily attached in the provisionally-retained position, and that the provisionally-retaining device for provisionally retaining the retainer should be simple in construction.

Therefore, one object of this invention is to provide a connector that enables a retainer to be easily provisionally retained.

Another object is to provide a connector positioning device of a simple construction that is capable of positively effecting such provisional retaining.

According to one aspect of the present invention, there is provided a connector having an integral retainer wherein the retainer is integrally molded on a connector housing through flexible hinge pieces. The connector housing has terminal receiving chambers having a tubular shape for respectively receiving metal terminals each connected to one end of a wire. Retainer insertion holes are open to one side of the terminal receiving chambers. The retainer includes a retainer body having terminal lock portions each insertable into the associated retainer insertion hole to engage a side of said inserted metal terminal to retain the metal terminal, and retaining pieces formed respectively at opposite ends of the retainer body in such a manner that the retainer has a gate-shape. The retaining pieces are attached respectively to opposite sides of the connector housing. The retainer can be attached in a provisionally-retained position where the retaining pieces are attached to the connector housing, without engaging the terminal lock portions with the metal terminals, and in a completely-retained position where the terminal lock portions engage the metal terminals. The retainer, attached in the provisionally-retained position, is slidingly movable along an outer surface of the connector housing into the completely-retained position.

According to a second aspect of the invention, there is provided a connector housing having terminal receiving chambers communicating with retainer insertion holes, recesses formed along outer surfaces of the connector housing and a guide projection formed on opposite sides of the connector housing; and a retainer flexibly molded on the connector housing through flexible hinge pieces adapted to fit within the recesses, the retainer including lock pieces that are engageable with the retainer insertion holes, and retaining pieces formed at each end of the retainer. The retaining pieces each have a guide slot that engages the guide projection when the lock pieces assume a provisionally retained position such that the flexible hinge pieces are disposed within said recesses while being transported to a terminal insertion station.

According to a third aspect of the present invention, there is provided a connector comprising a connector housing having terminal receiving chambers that communicate with retainer insertion holes, a guide projection formed on opposite sides of the connector housing, and a lock projection formed on the opposite sides adjacent the guide projection. The connector includes a retainer that is flexibly molded on the connector housing through flexible hinge pieces. The retainer includes lock pieces that are engageable with the retainer insertion holes, and retaining pieces formed at each end of the retainer. The retaining pieces each have a guide slot that 1) engages the guide projection when the retainer assumes a provisionally retained position while being transported to a terminal insertion station, and 2) engages the guide projection and the lock projection when the retainer assumes a completely retained position, and the lock pieces have secured terminals that have been transported to said terminal insertion station.

In yet another aspect of the present invention, there is provided a method for connecting terminals to a connector having a connector housing and a pair of retainers that are hingeably connected to the connector housing. The method includes positioning the retainers in a provisionally retained position such that flexible hinge pieces formed on the retainers are disposed within protective recesses provided an outer surfaces of the connector housing, inserting terminals into terminal receiving chambers of said connector housing to effect primary retaining of the terminals while the retainers are in the provisionally retained position; and shifting the retainers toward the connector housing until lock pieces of the retainers effect secondary retaining of the terminals.

In still another aspect of the present invention, there is provided a method for conveying and positioning a connector having a connector housing and a pair of retainers that are hingeably connected to the housing. The retainers are capable of being in open and provisionally retained positions. The method comprises the steps of transporting the connector in a conveying direction in the open position along a positioning device using a transfer mechanism to engage a portion of the connector housing, guiding the connector housing between upstanding walls of the positioning device, guiding the retainers along respective guide surfaces such that the retainers are moved from the open position towards the provisionally retained position, and pushing the retainers to the provisionally-retained position.

According to yet another aspect of the invention, there is provided a connector positioning and conveying device for a connector having a retainer integrally molded on a connector housing through flexible hinge pieces. The device includes a transfer device for transferring the connector housing along a transfer direction; a guide provided along the transfer device for guiding each of the retaining pieces from an open position to a predetermined position; and a pusher for pushing the retainer in a direction perpendicular to the transfer direction, thereby urging the retainer from the predetermined position to a provisionally retained position.

For attaching the retainer to the connector housing, the hinge pieces are deformed in such a manner that the retainer is disposed along an outer surface of the connector housing. When the retainer is urged in a direction perpendicular to the outer surface, the retaining pieces, formed respectively at the opposite ends of the retainer body having a gate-shape, are engaged respectively with the side surfaces of the connector housing, thereby attaching the retainer to the connector housing. At this time, the retainer can be attached in the provisionally-retained position where the terminal lock portions do not engage the metal terminals, and in the completely-retained position where the terminal lock portions engage the metal terminals. The two positions are spaced from each other in a forward-backward direction along the outer surface of the connector housing. Therefore, the retainer, positioned in registry with the provisionally-retained position, is pushed so that the retainer can be attached in the provisionally-retained position. Then, for moving the retainer into the completely-retained position, the retainer is slidingly moved along the outer surface of the connector housing, so that the retainer can be moved into the completely-retained position. As a result, the terminal lock portions of the retainer are inserted respectively into the terminal receiving chambers through the respective retainer insertion holes to lockingly engage the sides of the respective metal terminals, thereby retaining the metal terminals in a secondary manner.

The connector housing is transferred by the transfer device. The retainer, provided at distal ends of the flexible hinge pieces, is transferred in such a manner that each of the retaining pieces is guided by the guide to be brought into a position disposed in registry with the provisionally-retained position, that is, the rear portion of a mounting recess. The retainer is attached to the provisionally-retained position by the pusher, which is moved in a direction perpendicular to the transfer direction. Namely, the transferred retainer is positioned by the guide means, and is pushed toward the connector housing in the direction perpendicular to the transfer direction. Therefore, the provisional-retaining device can be simplified in construction.

According to the present invention, the retainer is located at a predetermined position disposed laterally of the connector housing, and is pushed in a direction perpendicular to the connector housing, so that the retainer can be provisionally retained relative to the connector housing. Therefore, the retainer can easily be provisionally retained. In addition, the retainer is guided to the position enabling the retainer to be provisionally retained relative to the connector housing, and the retainer is pushed perpendicularly to the connector housing. Therefore, the provisional retaining device can achieve the provisional retaining using a simple construction.

BRIEF DESCRIPTION OF THE DRAWINGS

The invention will now be described in detail with reference to the following drawings, wherein.

DETAILED DESCRIPTION OF PREFERRED EMBODIMENTS

Figure 1:
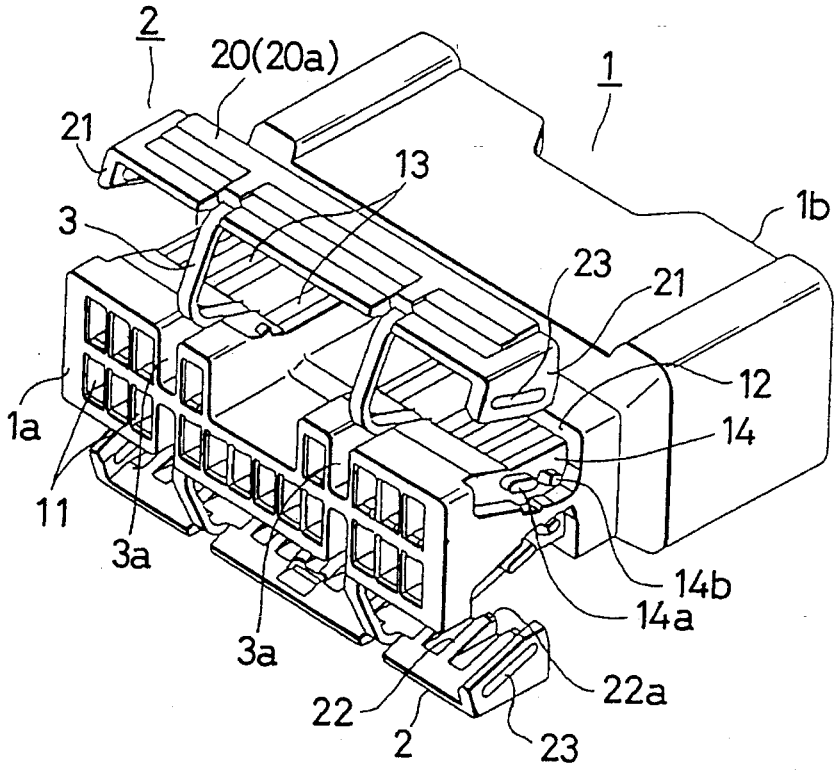
FIG. 1 is a perspective view of a connector.

One preferred embodiment of the present invention will now be described with respect to a male connector housing 1 shown in FIG. 1. A connector comprises a connector housing t having a generally rectangular parallelepiped shape and made of an integrally molded resin. Two retainers 2 and 2 are provided respectively on an upper and a lower surface of the connector housing 1, and are integrally molded at distal ends of strap-like hinge pieces 3. A number of tubular terminal receiving chambers 11, arranged in two (upper and lower) rows in a honeycomb manner and separated from one another, are open to one end face (rear end face) 1*a* of the connector housing 1. When a male metal terminal (not shown), connected to one end of a wire, is inserted into the terminal receiving chamber 11, the metal terminal engages a lance (not shown), provided within the terminal receiving chamber 11, to be retained primarily. A distal end of the inserted metal terminal is disposed near the other end face (front end face) of the connector housing 1, and can, be connected to a female metal terminal received in a mating female connector housing.

A covering recess 12 is formed in each of the upper and lower side surfaces of the connector housing 1, and the retainer 2 is mounted in the recess in a manner to cover the recess. Retainer insertion openings 13, each open to one side of the associated terminal receiving chamber 11, are formed in the covering recess 12. Each retainer insertion opening 13 extends in a slit-like manner in a forward-backward direction.

Mounting recesses 14, corresponding to the associated covering recesses 12, are formed in each of right and left sides of the connector housing 1. A guide projection 14*a* for mounting the retainer 2 is formed at a central portion of the mounting recessed portion 14, and slants in the forward-backward direction. A lock projection 14*b* is formed and disposed on an extension line of the guide projection 14*a*. The guide projections 14*a* lock the retainer 2 in a provisionally-retained position, and the lock projections 14b lock the retainer 2 in a completely-retained position, as later described.

As shown in FIG. 1, each retainer 2 is generally gate-shaped, and includes a retainer body 20 for being mounted in the covering recess 12 to cover the same. Arms or retaining pieces 21 are formed on opposite ends of the retainer body 20. By integral molding, each retainer is supported on the distal ends of the flexible strap-like, deformable hinge pieces 3 provided respectively at right and left portions of the upper and lower side surface of the connector housing 1. Each hinge piece 3 is insertable within recesses 3a formed in the housing. An outer surface of the retainer body 20 serves as a push surface 20a used when urging the retainer 2 toward the connector housing 1.

Lock pieces 22 having a triangular shape correspond to the respective retainer insertion openings 13, and are formed on and project forwardly from the inner surface of the retainer body 20. A front end of each lock piece 22 is,formed into a terminal lock portion 22a that engages the side of the associated metal terminal when the lock piece 22 is brought into the completely-retained position.

A guide slot 23 is formed in the retaining piece 21, and can be fitted on the guide projection 14a and the lock projection 14b to attach the retainer 2 to the connector housing 1.

Figure 2:
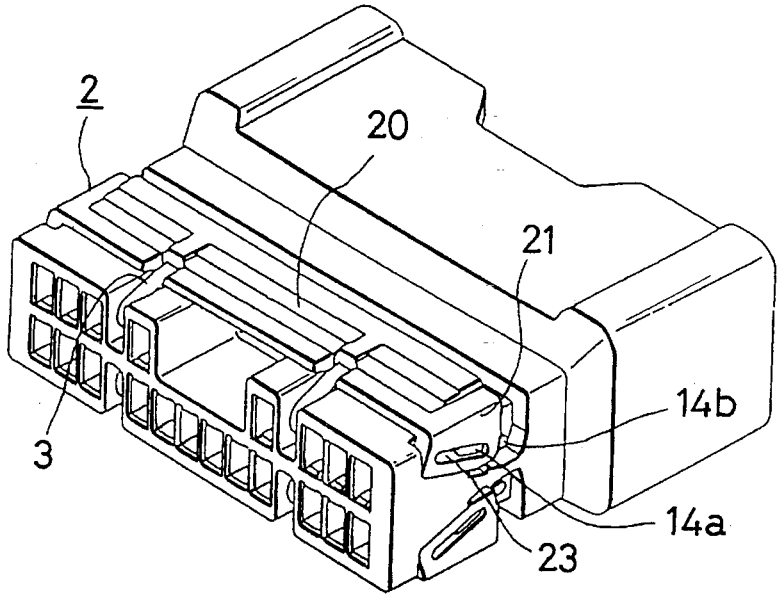
FIG. 2 is a perspective view showing retainers in their provisionally-retained condition.
Figure 3:
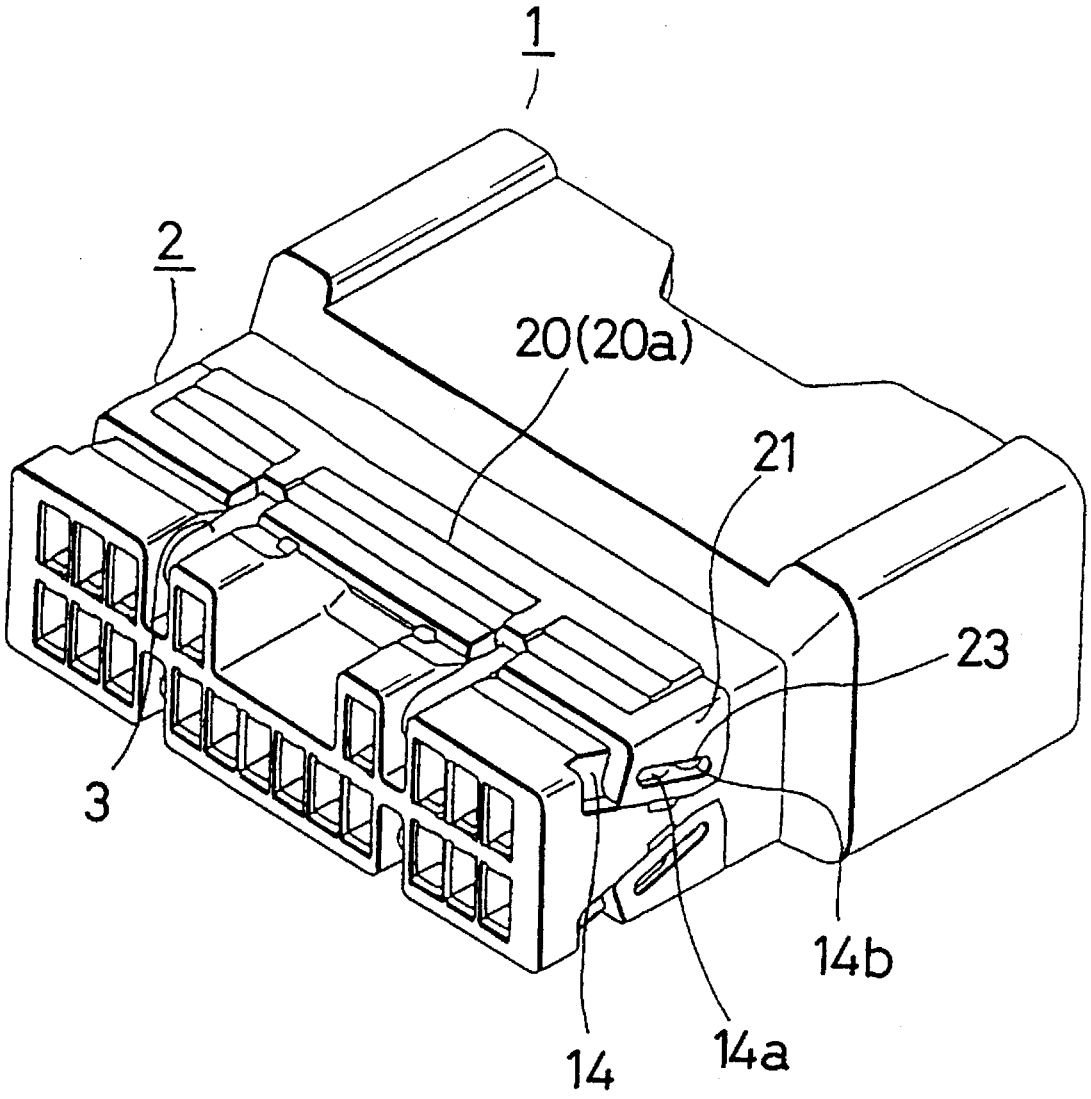
FIG. 3 is a perspective view showing the retainers in their completely-retained condition.

The retainer can be attached in the provisionally-retained position shown in FIG. 2 and also in the completely-retained position shown in FIG. 3. The retainer 2 is slidingly moved forward and backward between the two positions along the guide projections 14a. More specifically, in the provisionally-retained position located at a rear portion of the mounting recess 14, the guide projection 14a is fitted in the associated guide slot 23, but is not fitted in the associated lock projection 14b, and the terminal lock portions 22a formed on the retainer body 20 are not received in the respective Therefore the lock terminal receiving chambers 11, portions are not engaged with the respective metal terminals, so that the insertion and withdrawal of the metal terminals are not prevented.

The metal terminals are inserted, and by pushing the push surface 20a, the retainer body 20 is moved forward from the provisionally-retained position, so that each retaining piece 21 is flexed outwardly to slide over the lock projection 14b, and the lock projection 14b is fitted in the guide slot 23, thereby holding the retainer in the completely-retained position. As a result, the terminal lock portions 22a of the retainer body 20 are introduced into the respective terminal receiving chambers 11 to respectively engage the sides of the metal terminals received in these chambers, thereby retaining the metal terminal in a secondary manner.

In the embodiment of the above construction, before the metal terminals are inserted into the terminal receiving chambers 11, respectively, each retainer 2 shown in FIG. 1 is first fitted in the upper and lower covering recesses 12 to cover the same, with the hinge pieces 3 flexed. At this time, the retainers are retained in their respective provisionally-retained positions shown in FIG. 2. For achieving this, each retaining piece 21 is first disposed at the rear portion of the associated mounting recess 14 so that the retaining piece 21 can be fitted only on the guide projection 14a, but can not be fitted on the lock projection 14b. Then, each retaining piece 21 is forced into the associated mounting recess 14 in a direction generally perpendicular to the upper (lower) side surface of the connector housing 1. As a result, each retaining piece 21 is elastically deformed to slide over the guide projection 14a, so that the guide slot 23 is fitted on the guide projection 14a, and the hinge pieces 3 are disposed within the connector housing 1.

In the provisionally-retained condition, the connector can be conveyed to a terminal insertion station pieces 63 without the possibility that the hinge pieces 3 are broken or cut by engagement with other member during conveyance.

In the terminal insertion step, in the provisionally-retained condition of the retainers 2, the metal terminals, connected respectively to one ends of the wires, are inserted respectively into the terminal receiving chambers 11, and are primarily retained by the respective lances (not shown) formed on the terminal. After the insertion of all of the metal terminals is completed, each retainer body 20 is moved forward along the guide projection 14a, and each retaining piece 21 slides over the lock projection 14b, so that the lock projection 14b in addition to the guide projection 14a is fitted in the slot 23. As a result, the retainer 2 is held in the completely-retained position (FIG. 3) by the two projections 14a and 14b fitted in each slot 23.

Figure 4:
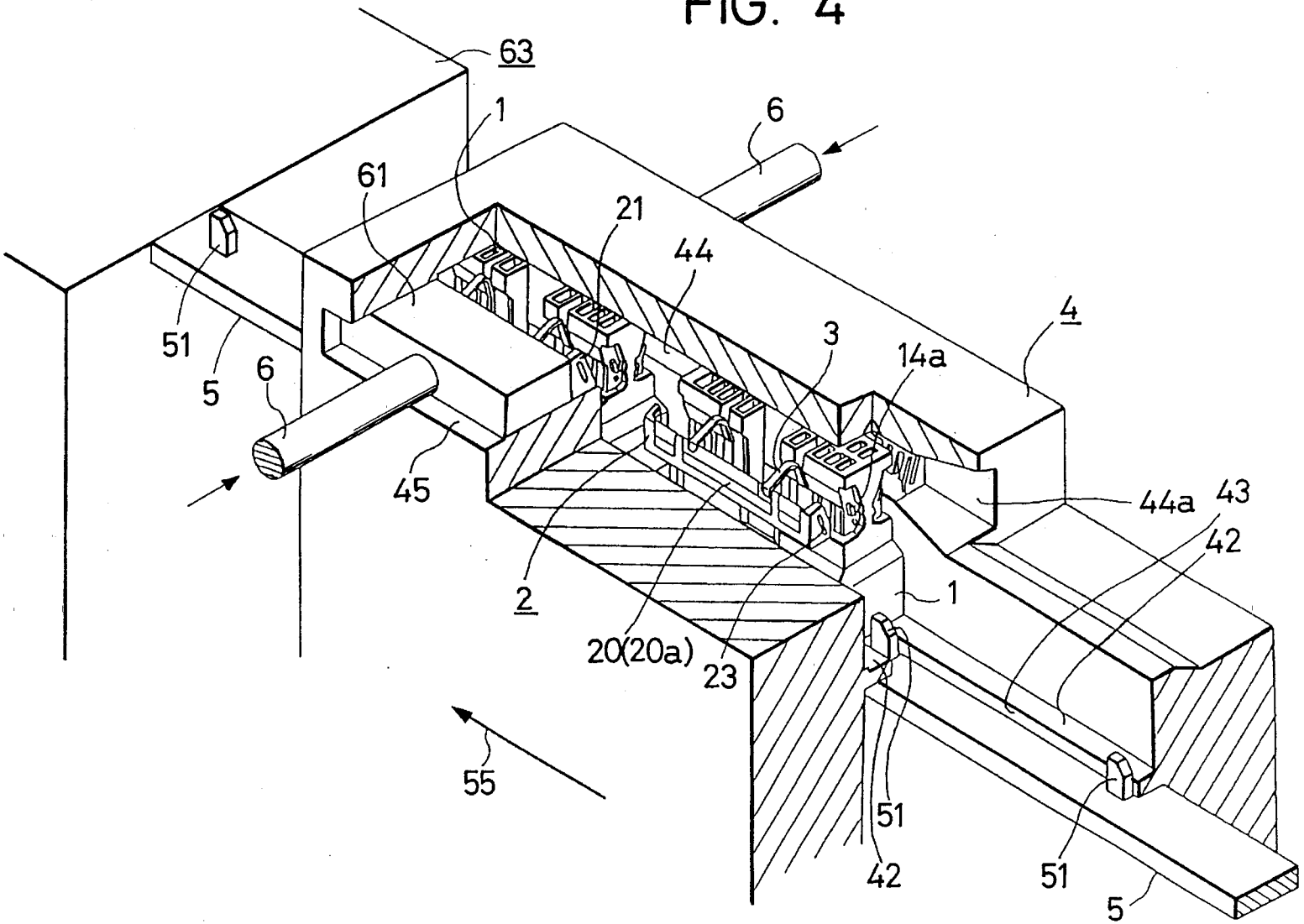
FIG. 4 is a partial perspective view of the provisional retaining, conveying and positioning device.
Figure 5:
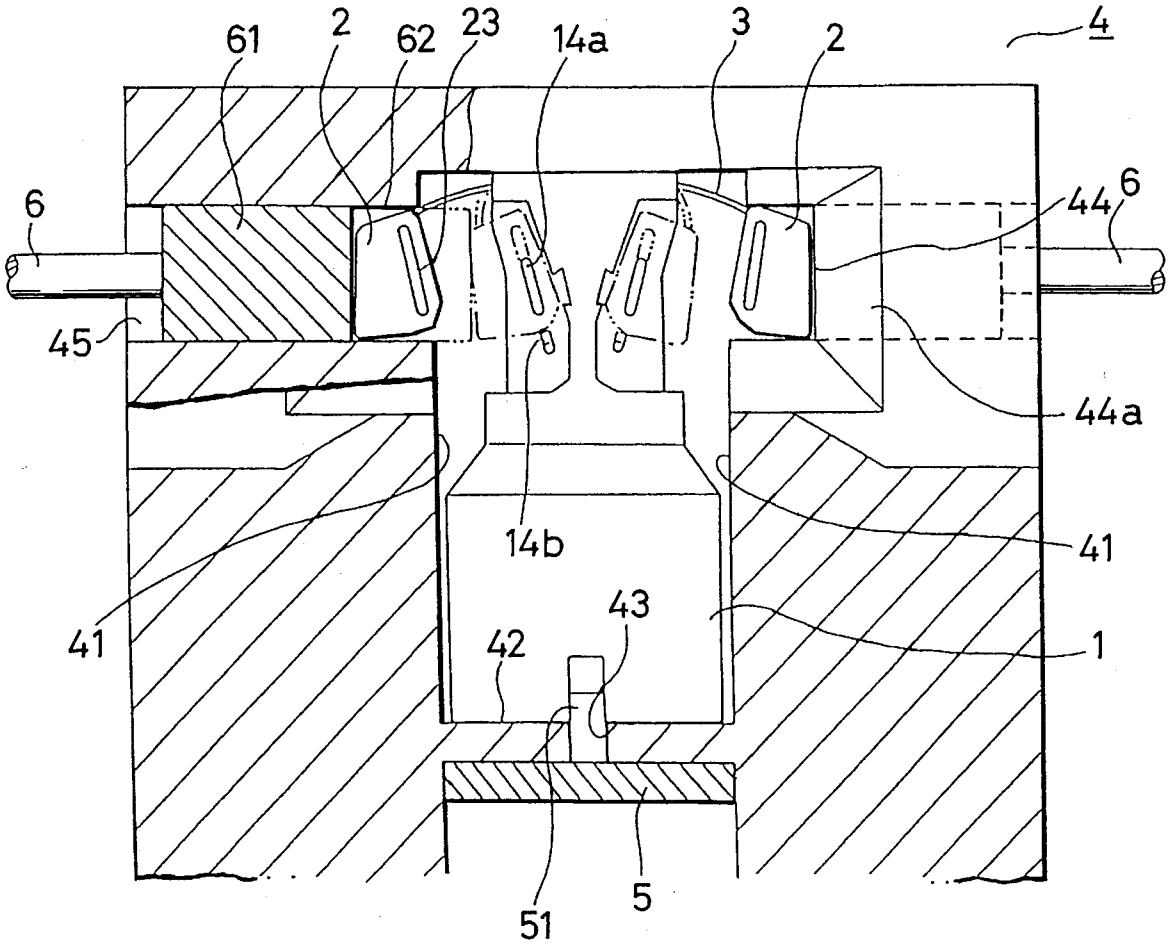
FIG. 5 is a cross-sectional view of the provisional retaining, conveying and positioning device.

Next, a provisional-retaining device for provisionally retaining the retainer 2 relative to the connector housing I as described above will be described. FIGS. 4 and 5 show a portion of the provisional-retaining device for the above-mentioned male connector housing 1. The provisional retaining device includes a device housing 4 of a generally tubular shape also serving as a guide, a transfer belt 5 for transferring the connector housings 1, and pushers 6.

The transfer belt 5 is intermittently driven in the direction of arrow 55 to be repeatedly moved and stopped in accordance with the operation of the pushers 6, and transfer pawls 51 are mounted on the transfer belts 5 at predetermined intervals.

The device housing 4 is of a tubular shape formed by side walls 41 upstanding respectively on opposite sides of the transfer belt 5, and right and left support surfaces 42 extending respectively from the opposite side walls 41 along an upper surface of the transfer belt 5. A movement gap 43 is formed between the support surfaces 42, and the transfer pawls 51 project through the movement gap, and move therealong. With this arrangement, the connector housing 1, supplied onto the support surfaces 42 from a supply device (not shown), is slidingly transferred to the device housing 4 by the transfer pawl 51 over the support surfaces 42 in accordance with the movement of the transfer belt 5.

The opposite side walls 41 and 41 are upstanding, and are spaced such a distance from each other that the connector housing I can be transferred therebetween. A retainer guide groove 44 is formed in each of the opposite side walls 41, and is disposed at a height corresponding to that of the provisionally-retaining position of the covering recess 12. Each retainer 2 can be fitted in and guided by the associated retainer guide groove 44 for movement therealong. Each retainer guide groove 44 is disposed outwardly of the rear portion of the mounting recess 14 at such a position that each retaining piece 21 of the retainer 2, supported by the flexible hinge pieces 3 extending from the connector housing 1, can fit only on the guide projection 14a but can not fit on the lock projection 14b. The retainer guide groove 44 has a channel-shaped cross-section so as to hold the retaining pieces 21 of the retainer 2 in a predetermined fitting posture.

A guide surface 44a is formed at an inlet portion of the retainer guide groove 44. The guide surface 44a is defined by upper, lower and side slanting surfaces converging in a direction away from a front end of the retainer guide groove, and the retainers 2 can be guided by the guide surface 44*a* into the retainer guide groove 44 in the predetermined posture in alignment with one another. Namely, because each retainer 2 of the transferred connector housing 1 is provided at the distal ends of the flexible hinge pieces 3, the posture of the retainer 2 is not constant. However, the retainer is guided by the guide surface 44*a* to be corrected in posture, and is fed into the retainer guide groove 44. A cylinder 45 is provided adjacent to the inner end of each retainer guide groove 44, and the pusher 6 serving as the pushing means is provided in this cylinder for movement between an extended and a retracted position in a direction perpendicular to the transfer direction. A pushing piece 61 is mounted on a front end of each of the pushers 6 and 6, and is slidingly movable in the cylinder 45. A front end face of the pushing piece 61 is flat, and pushes the push surface 20*a* of the retainer body 20 in such a manner that the push surface 20*a* is kept upright. In the retracted position of the pusher 6, the push surface of the pushing piece 61 is continuous with the bottom surface of the retainer guide groove 44, so that the transferred retainer 2 can be received without being changed in posture.

When the connector housing 1, transferred by the transfer pawl 51 on the transfer belt 5, contacts the guide surfaces 44*a*, each retainer 2 is guided by the associated guide surface 44*a* to be corrected in posture vertically and horizontally in accordance with the transfer thereof, and is transferred into the retainer guide groove. 44. As a result, the retainer is positioned laterally of the provisional-retaining position. Then, when the retainer is moved into a position where it faces the front face of the pushing piece 61, the transfer belt 5 is stopped. Then, the pushing piece 61 urges the retainer 2 toward the covering recess 12. As a result, each retaining piece 21 slides over the guide projection 14*a*, and the guide slot 23 fits on the guide projection 14*a*, as shown in dots-and-dash lines in FIG. 5. At this time, the retainer 2 is pushed laterally perpendicularly from a position disposed outwardly of the rear portion of the mounting recess 14, so that the retainer is mounted in the provisionally-retained position. Then, each pusher 6 is retracted, and the transfer belt 5 is again driven to transfer the connection housing 1 in the provisionally-retained condition out of the device, and at the same time the subsequent connector housing 1 is fed to the position between the bushing pieces 61.

The connector housing 1 in the provisionally-retained condition is transferred to a terminal insertion section. In the terminal insertion section, the metal terminals, compressively connected respectively to one end of each wire, are inserted to be primarily retained. Then, each retainer 2 is moved obliquely forwardly along the guide projection 14*a*, either manually or by machine, so that the lock projection 14*b* is also fitted in the guide slot 23, thereby holding the retainer 2 in the completely-retained position.

In this embodiment, although each retainer 2 is brought into the provisionally-retained position by one pusher 6, the bushing piece 61 can be of such a construction as to simultaneously push a plurality of retainers.

In this embodiment, although the male connector has been described, the invention can also be applied to a female connector.

The invention has been described in detail with reference to preferred embodiments thereof, which are intended to be illustrative but not limiting. Various changes may be made without departing from the spirit and scope of the invention as defined in the appended claims.

What is claimed is:

1. A connector comprising an integral retainer that is molded on a connector housing through flexible hinge pieces, wherein:

said connector housing comprises tubular shaped terminal receiving chambers for receiving metal terminals that are each connected to an end of a wire, retainer insertion holes open to one side of said terminal receiving chambers, and recesses formed by substantially parallel walls within the connector housing for receiving said hinge pieces;

said retainer includes a retainer body having terminal lock portions each insertable into respective ones of said retainer insertion holes to retain and engage a side of each said inserted metal terminal, and retaining pieces formed respectively at opposite ends of said retainer body in such a manner that said retainer has a gate-shape, said retaining pieces being attached respectively to opposite sides of said connector housing; and said retainer is attachable in a provisionally-retained position where said hinge pieces are protectively disposed within said recesses in said connector housing, said retaining pieces are attached to said connector housing, and terminal lock portions formed on said connector housing being disengaged from said metal terminals, said retainer also being attachable in a completely-retained position where said terminal lock portions engage with respective said metal terminals, said retainer being slidingly movable along an outer surface of said connector housing into said completely-retained position.

2. A connector comprising:

a connector housing having terminal receiving chambers communicating with retainer insertion holes, at least one recess formed by substantially parallel walls in a central portion within outer surfaces of the connector housing and guide projections formed on opposite sides of the connector housing; and a retainer flexibly molded on the connector housing through at least one flexible hinge piece adapted to fit within the at least one recess, said retainer including lock pieces that are engageable with the retainer insertion holes, and retaining pieces formed at each end of the retainer, said retaining pieces each having a guide slot that engages one of the guide projections when the lock pieces assume a provisionally retained position such that said at least one flexible hinge piece is disposed within said at least one recess during transportation to a terminal insertion station.

3. A connector comprising:

a connector housing having terminal receiving chambers communicating with retainer insertion holes, a guide projection formed on each of opposite sides of the connector housing, and a lock projection formed on said each of said opposite sides adjacent said guide projection; and a retainer flexibly molded on the connector housing through flexible hinge pieces, said retainer including lock pieces that are engageable with the retainer insertion holes, and retaining pieces formed at each end of the retainer outside the flexible hinge pieces, said retaining pieces each having a guide slot that 1) engages the corresponding guide projection when the retainer assumes a provisionally retained position while being transported to a terminal insertion station, and 2) engages the corresponding guide projection and the adjacent lock projection when the retainer assumes a completely retained position, and the lock pieces thus secure terminals that have been inserted at said terminal insertion station, said connector housing further including recesses receiving said flexible hinge pieces during said transportation.

4. The connector of claim 3, wherein the connector housing includes a covering recess structured to receive said retainer.

5. The connector of claim 3, wherein the guide projection and the adjacent lock projection are formed in a mounting recess formed in said opposite sides of said connector housing.

6. The connector of claim 3, wherein said retaining pieces are adapted to elastically flex to selectively receive said corresponding guide projection and said adjacent lock projection in said guide slot.

7. The connector of claim 3, wherein the flexible hinge pieces are protectively disposed within the recesses.

8. The connector of claim 3, wherein the connector housing and the retainer are conveyed and positioned by a mechanism so that the retainer is moved from an open position in which neither the corresponding guide projection nor the adjacent lock projection engages said guide slot to said provisionally retained position.

9. The connector of claim 8, wherein the mechanism includes:

transfer means for transferring the connector housing in a transfer direction;

guide means provided along said transfer means for guiding said retainer to a predetermined position; and push means for pushing the retainer in a direction perpendicular to the transfer direction, thereby urging the retainer from the open position to the provisionally retained position.

10. A method for connecting terminals to a connector having a connector housing and a pair of retainers that are hingeably connected to the connector housing, comprising the steps of:

positioning the retainers in a provisional retained position such that flexible hinge pieces formed on the retainers are disposed within protective recesses provided within outer surfaces of the connector housing between terminal receiving chambers of said connector housing;

inserting terminals into said terminal receiving chambers to effect primary retaining of the terminals while the retainers are in said provisionally retained position; and shifting the retainers toward the connector housing until lock pieces of the retainers effect secondary retaining of the terminals.

11. The method of claim 10, wherein the positioning step includes engaging grooves of retaining pieces formed on opposite ends of the retainer of guide projections formed on opposite ends of the connector housing, and the shifting step includes engaging said grooves with lock projections formed on said opposite ends of said connector housing adjacent said guide projections.

* * * * *